United States Patent [19]

Arsi

[11] Patent Number: 4,951,877

[45] Date of Patent: Aug. 28, 1990

[54] HIGH-VERSATILITY DEVICE FOR CLEANING SURFACE BY MEANS OF A LIQUID JET

[75] Inventor: Giuseppe Arsi, Reggio Emilia, Italy

[73] Assignee: Interpump - S.p.A., Italy

[21] Appl. No.: 365,787

[22] Filed: Jun. 14, 1989

[30] Foreign Application Priority Data

Jun. 15, 1988 [IT] Italy ..... 46861 A/88

[51] Int. Cl.[5] ..... B05B 3/04

[52] U.S. Cl. ..... 239/240; 239/443

[58] Field of Search ..... 239/237, 240, 252, 456, 239/436, 443

[56] References Cited

U.S. PATENT DOCUMENTS

| | | | |
|---|---|---|---|
| 2,126,243 | 10/1939 | Braungart | 239/252 X |
| 2,986,339 | 5/1961 | Kouik et al. | 239/252 X |
| 2,986,344 | 5/1961 | Knight | 239/252 X |
| 3,008,646 | 11/1961 | Bonak | 239/252 X |
| 3,792,584 | 2/1974 | Drew et al. | 239/237 |
| 4,440,345 | 4/1984 | Figwer et al. | 239/237 |
| 4,747,544 | 5/1988 | Kranzle | 239/252 X |
| 4,802,628 | 2/1989 | Dautel et al. | 239/240 X |
| 4,815,662 | 3/1989 | Hunter | 239/252 X |

*Primary Examiner*—Andres Kashnikow
*Assistant Examiner*—Kevin P. Weldon
*Attorney, Agent, or Firm*—Birch, Stewart, Kolasch & Birch

[57] ABSTRACT

A device for cleaning surfaces in general by means of a liquid jet comprises a cleaning liquid entry duct (1) in which a hollow shaft (3) fitted with a drive impeller (9) is rotatably mounted. After traversing the impeller, the liquid enters the shaft to then exit in the form of a compact filiform jet through a nozzle (6) which is inclined to the longitudinal axis of rotation of the shaft. The speed of rotation of the shaft and hence of the jet can be adjusted at will from zero to a maximum value by a braking unit (23, 24). There is also provided a selector (88) arranged to assume a first position in which it enables all the liquid to enter the hollow shaft, and a second position in which part of the liquid is deviated upstream of the impeller and discharged downstream of the impeller as an atomized conical jet.

8 Claims, 3 Drawing Sheets

HIGH-VERSATILITY DEVICE FOR CLEANING SURFACE BY MEANS OF A LIQUID JET

SUMMARY OF THE INVENTION

The present invention relates to a device for cleaning surfaces by means of a high-speed water jet.

In this type of device, for a given available power, the jet efficiency is proportional to its speed, and this is obtained at the expense of the jet cross-section being a maximum when the jet assumes a filiform configuration.

This creates a drawback in terms of the smallness of the surface covered by the jet, this drawback being remedied in known devices by using inclined nozzles which rotate at high speed and by which the jet travels through a conical surface and basically reproduces circumferences on the surface to be cleaned. However because of the tendency of the jet to atomize on contact with the air, a tendency aggravated by the fact that the jet rotates, the known methods only rarely enable sufficient efficiency to be obtained at the desired distance.

This gives rise to the requirement of being able to infinitely adjust at least the rotational speed of the jet. A further drawback of known delivery devices is that they have only one delivery mode, i.e. with a nozzle of small cross-section and a high-speed jet. This delivery mode involves high pressure, which makes it impossible for the ejector to operate as a venturi tube through which the detergent is mixed. This results in a requirement for delivery devices which can operate both at high pressure, with small cross-section nozzles, and at low pressure, with larger cross-section nozzles, and which can be switched from one operating mode to another by a simple action on the device. The present application provides a high-versatility device which is able to deliver both a filiform jet rotating at a speed adjustable from zero to a maximum value, and an atomized conical jet of greater cross-section.

To this end the device comprises, rotatably mounted on a water feed duct, a shaft provided at its end with an inclined nozzle and at its base with a bladed impeller traversed by the water, and an infinitely adjustable centrifugal brake, for example of the ball type, provided on said shaft in an intermediate position.

According to the present invention the aforesaid system is contained in a sleeve which forms with the shaft an interspace through which all or part of the flow can be bypassed in order to be delivered concentrically to said rotatable nozzle.

Finally according to the present invention said outer sleeve can be moved axially to the shaft, by which said bypass is made to progressively open or close, and also be turned about the shaft, by which the centrifugal brake is made to progressively engage or disengage.

The centrifugal brake is in the form of a series of balls or rollers housed in respective transverse seats which rotate rigidly with the shaft, and are urged by centrifugal force against an outer annular track. This latter can be adjusted longitudinally relative to the shaft, and comprises roughness the degree of which increases when moving from one end to the other, so that the resistance offered to the rotary motion of the balls depends on the position occupied by the annular track. A locking member is also provided fixed to the rotatable shaft and arranged to engage with the annular track to halt the rotation of the hollow shaft and thus the jet, and therefore to keep the jet orientated in the desired direction.

BRIEF DESCRIPTION OF THE DRAWINGS

The characteristics and constructional merits of the invention will be more apparent from the detailed description given hereinafter with reference to the accompanying figures which show two preferred embodiments by way of non-limiting example only.

DETAILED DESCRIPTION OF THE INVENTION

Figure 1:
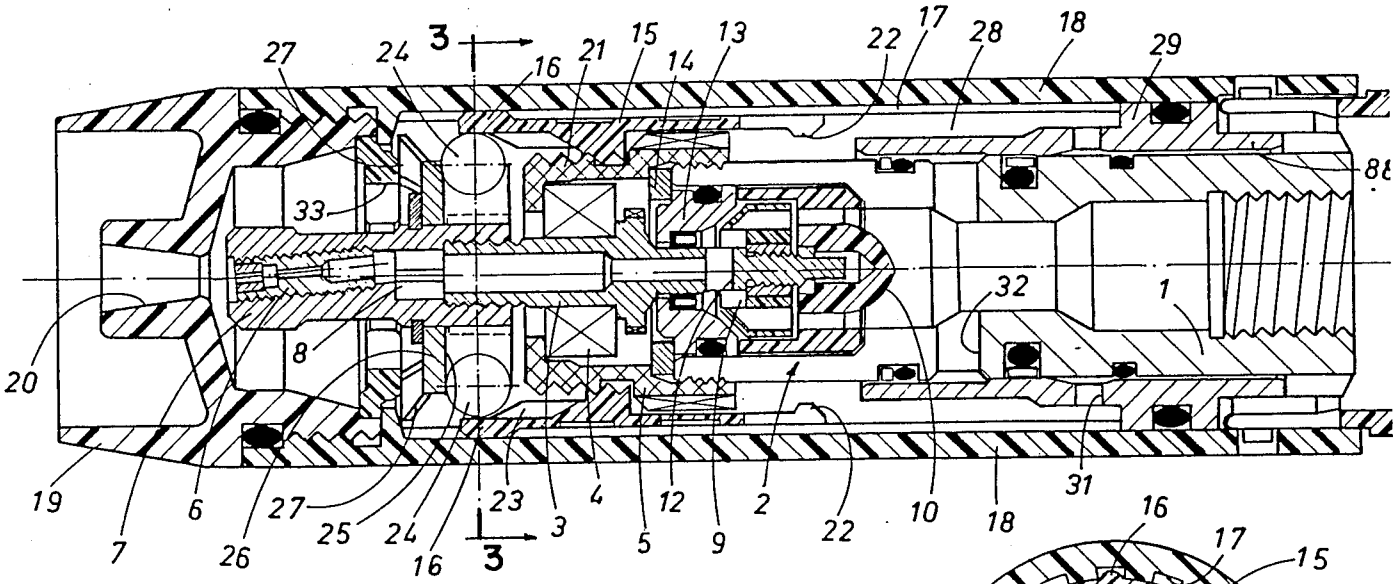
FIG. 1 is a longitudinal section through the device of the invention in the configuration in which it is arranged to generate a rotating filiform jet.
Figure 2:
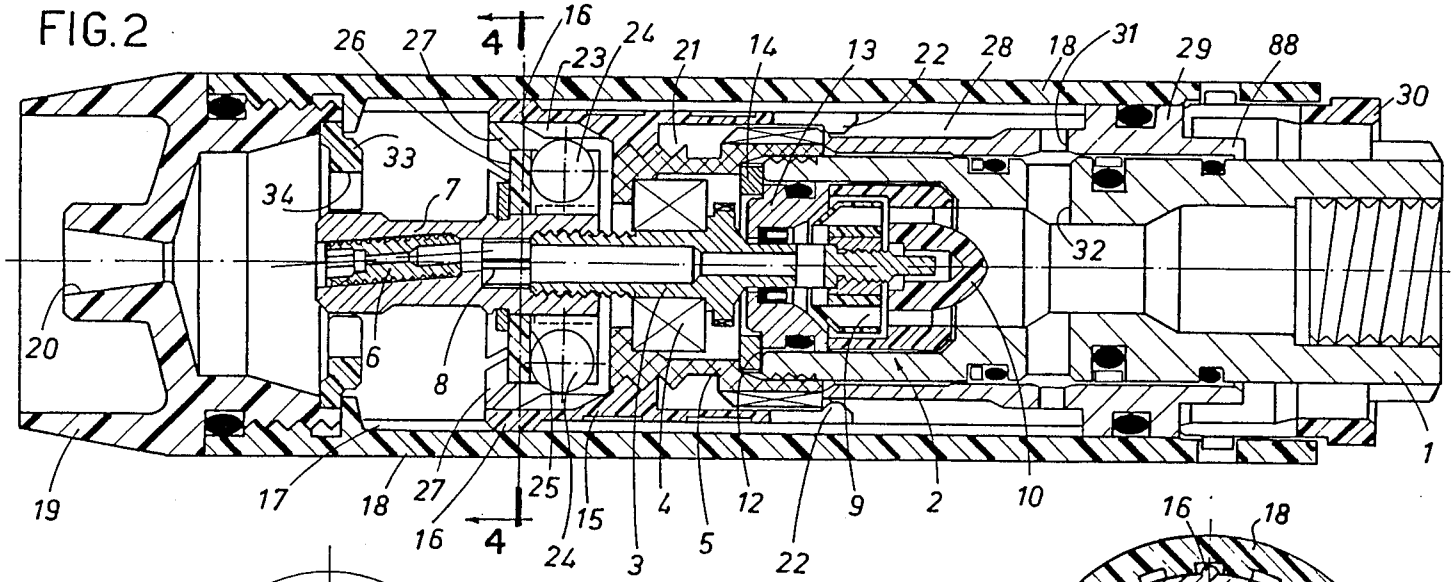
FIG. 2 is a view similar to FIG. 1, in which the device of the invention is shown in the configuration for generating a conical jet of greater cross-section.

FIGS. 1 to 6, and in particular FIGS. 1 and 2, show a hollow cylindrical member 1 forming the entry duct for the cleaning liquid, such as water or water mixed with detergents. The member 1 is intended to be connected to a pressurised liquid source, such as a fixed or portable pump, or piston or other type of similar device. With reference to the operating position shown in FIG. 1, at its exit from the member 1 the liquid enters rotatable hollow shaft 3, to the base of which there is fixed the impeller 9 of a turbine 2, which is traversed by the water flow.

By way of a thrust bearing 4 the shaft 3 is mounted in a support socket 5 which is screwed onto the downstream end of the member 1. After traversing the hollow shaft 3, the liquid enters a nozzle 6, from which it emerges at high speed as a compact filiform jet. As can be seen, the nozzle 6 is inclined to the longitudinal axis of the hollow shaft 3, and is housed in a head 7 fixed onto the downstream end of the amount of shaft. In the illustrated case said inclination is about 4 degrees, between said nozzle 6 and shaft 3 there being interposed a member 8 with its cross-section in the form of a right cross (see FIG. 4), the purpose of which is to straighten the fluid threads in transit. With further reference to FIG. 1, the turbine 2 for driving the hollow shaft 3 comprises a bladed impeller 9 which is fixed onto the upstream end of the shaft 3, and is struck by the liquid leaving a stator 10, which is locked within the member 1. The stator 10 comprises a central nose and a circumferential series of equiorientated equidistant inclined passages, the inclination of which opposes that of the blades of the impeller 9. An aperture 12 is provided diametrically in the shaft 3 to open into the axial cavity of the latter. The aperture 12 collects the water which has passed through the impeller. Finally, it should be noted that the stator 10 is fixed by an annular member 13 which is inserted in a fluid-tight manner into the member 1 and is traversed in a fluid-tight manner by the shaft 3. In addition, the annular member 13 is fixed by a ring 14, which is clamped against the upstream end of the member 1 by the said support socket 5.

According to the present invention the elements heretofore described enable the device, when in the configuration shown in FIG. 1, to generate a compact rotating filiform jet which sweeps a conical surface having its origin in the nozzle 6. It is apparent that the rotational speed of the shaft 3 and hence of the jet depends inter alia on the pressure and flow rate of the entering liquid. By way of example, in tests carried out with a model according to the present invention, a rotating speed of the filiform jet of more than 10,000 r.p.m. was attained when the operating pressure was 60–70 atm.

According to the present invention the speed at which the filiform jet rotates can be adjusted by the means described hereinafter, to values of the order of 1000–2000 r.p.m.

Figure 3:
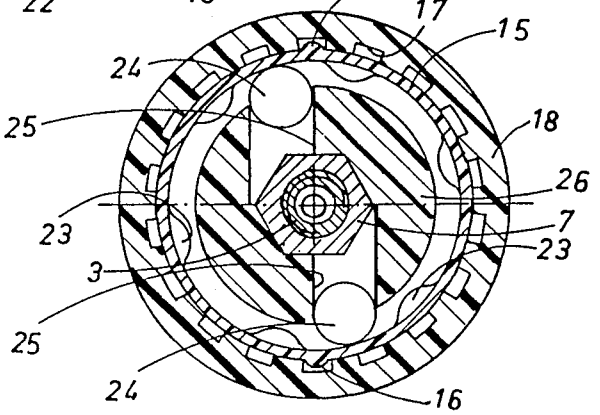
FIG. 3 is a section taken along line III—III of FIG. 1.

With reference to FIGS. 1, 2 and 3 said means comprise a bushing 15 provided with at least two outer longitudinal ribs 16 which are received in corresponding longitudinal channels 17 provided in the inner surface of an outer sleeve 18. As can be seen, this outer sleeve encloses all the previously described elements and is provided on its downstream end with a nosepiece 19 tapered toward the center to form a mouthpiece 20.

The mouthpiece 20 is not struck by the filiform jet leaving the nozzle 6. However it has been found that the action of the jet as it rotates and skims the mouthpiece 20 creates a sucking action which causes any water which may have seeped into the zone surrounding the nozzle to be drawn out. It should be also noted that the grooves 17 in the sleeve 18 are torsionally but not axially engaged with the ribs 16 of the bushing 15. In addition, the number of grooves 17 is greater than the number of ribs 16 (see FIG. 4) for the reasons given hereinafter.

From FIGS. 1 and 2 it can be seen that the bushing 15 is provided internally with an intermediate threaded portion which is engaged by a corresponding thread 21 provided on the socket 5.

Figure 4:
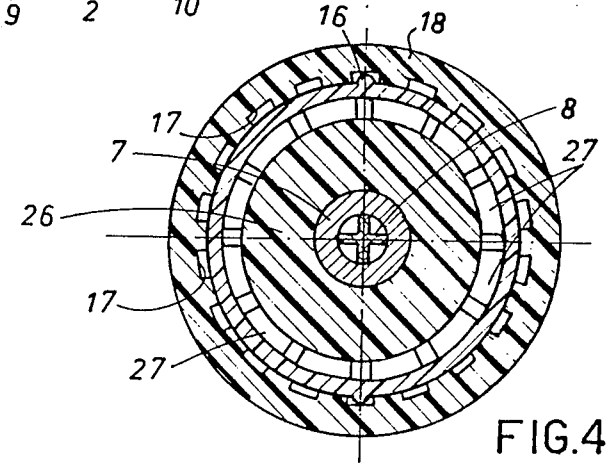
FIG. 4 is a section taken along line IV—IV of FIG. 1.
Figure 5:
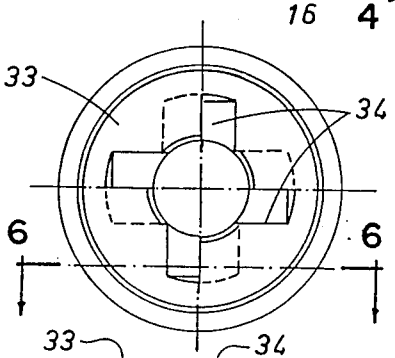
FIG. 5 is a frontal view of the deviator for creating the conical jet.
Figure 6:
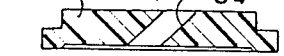
FIG. 6 is a section taken along line VI—VI of FIG. 5.

The upstream end of the bushing 15 is divided into sectors by a circumferential series of longitudinal cuts, each sector being provided with an inner terminal tooth 22 arranged to act as a limit stop for the forward movement of the bushing 15 (see FIG. 2). In addition, the threaded portion of the bushing acts of a limit stop for its rearward movement as shown in FIG. 4. Downstream of said inner threaded portion there is provided inside the bushing 15 a cylindrical surface, a downstream-situated portion of which is perfectly smooth, while its remaining upstream portion is provided with a circumferential series of small equidistant longitudinal projections 23. As can be seen in FIG. 3, these projections have a convex-arched transverse shape and their downstream ends (see FIGS. 1 and 2) are connected to said perfectly smooth portion by respective inclined planes.

The two inner surface portions of the bushing 15 form a rolling track for two balls 24 which are freely inserted into respective transverse cavities 25 provided on a disc 26. The disc is torsionally engaged with the head 7 by a prismatic fit, and is axially locked, as illustrated. It can also be seen from FIGS. 1, 2 and 4 that on the downstream end of the disc 26 there is provided an outer circumferential series of equidistant radial tongues 27 which are inclined in the downstream direction and are elastically deformable. The free ends of the tongues 27 lie along an ideal circumference of diameter greater than the inner diameter of the smooth portion of the bushing 15 (see FIGS. 1, 4).

Starting from the operating position shown in FIG. 1, in order to adjust (reduce) the speed at which the filiform jet rotates it is necessary only to rotate the sleeve 18, which then rotates the bushing 15. Because of its threaded engagement with the support 5, the bush 15 moves downstream as it rotates. This means that the resistance offered to the balls by the projections 23 continuously increases with simultaneous reduction in the speed with which the shaft 3 rotates. On continuing to turn the sleeve 18, at a certain point the braking effect of the projections 23 is increased by the friction action of the tongues 27. Finally, when the bushing 15 mounts these latter to deform them, the hollow shaft 3 stops. After this, the bushing 15 can still be rotated through at least one complete revolution to enable the now stationary inclined filiform jet to be moved into the desired angular position relative to the longitudinal axis of the device. This can be seen from FIG. 1.

The reverse procedure is carried out to release the shaft 3 and increase its speed of rotation up to its maximum value, as stated heretofore.

Finally, it is possible to pass from the configuration of FIG. 1 (compact filiform jet) to the configuration of FIG. 2 (atomized conical jet) whatever the degree of adjustment of the braking unit. To do this it is neceassary merely to push the sleeve 18 in a downstream direction by which most of the liquid flow enters a bypass ducting which will now be described. The ducting consists of an annular chamber 28 lying between the sleeve 18 and the member 1, the free grooves 17 of said sleeve 18, and the nosepiece 19 of the sleeve. In addition, on the upstream end of the member 1 there is slidingly mounted, in a fluid-tight manner, a selector bush 88 which is received in a fluid-tight manner in the sleeve 18. Said selector bushing 88 is provided with a circumferential ledge 29 which lies between the upstream ends of the projections defining the grooves 17 in the sleeve 18, and a retention ring 30 removably fitted into the mouth of said sleeve 18. When this latter is moved downstream as stated, the through holes 31 provided in the bushing 88 communicate with the through holes 32 provided in the member 1 upstream of the stator 10. As stated, in this configuration most of the liquid reaches the nosepiece 19 without traversing the impeller 9. In addition, before reaching the nosepiece 19 the liquid traverses a ring 33 embracing the head 7 (see FIG. 2), which is clamped between the sleeve 18 and the nosepiece 19. Finally, as can be best seen in FIGS. 5 and 6, the ring is provided with a circumferential series of equiorientated and equidistant inclined apertures 34. As the bypassing liquid traverses the apertures 34 it is subjected to a screwing movement which enables it to expand beyond the mouthpiece 20 in the form of an atomized conical jet which also contains that part of the liquid emerging from the nozzle 6.

Lastly, the advantage should be noted deriving from the fact that the operating position of the device shown in FIG. 2 cannot be changed by the effect of the liquid penetrating into the nosepiece 19. This avoids the risk of the device passing accidentally from the low speed atomized conical jet condition to the high speed filiform jet condition, with its easily imaginable consequences.

Figure 7:
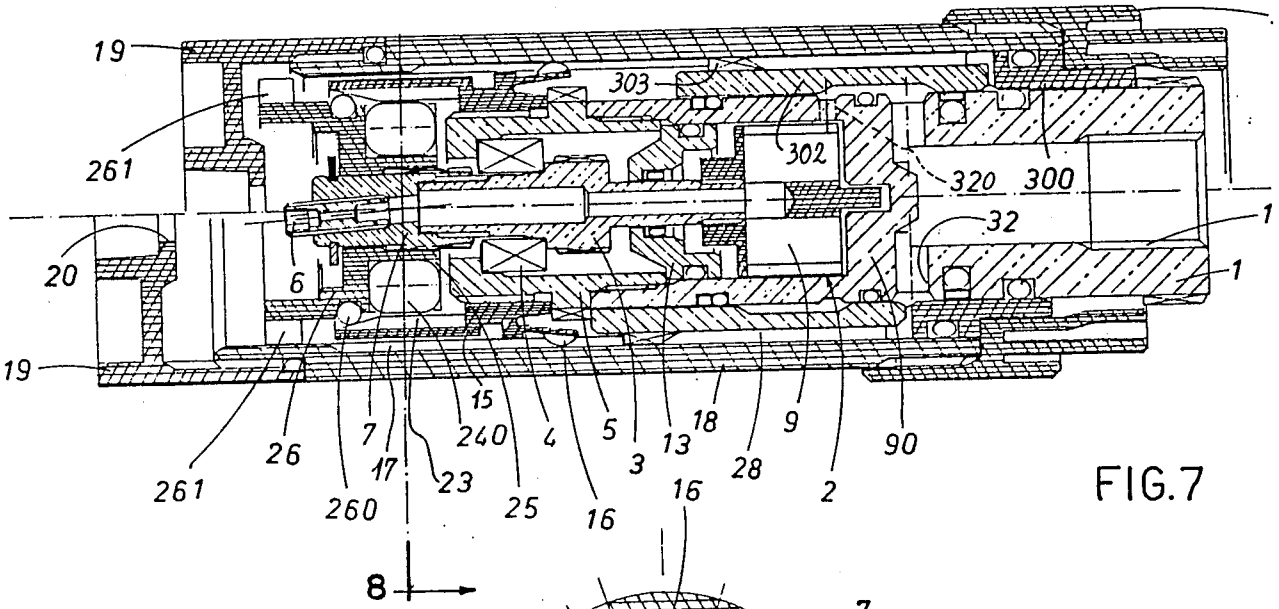
FIG. 7 is a longitudinal section through a second embodiment of the device of the present invention; and in two operating positions.
Figure 8:
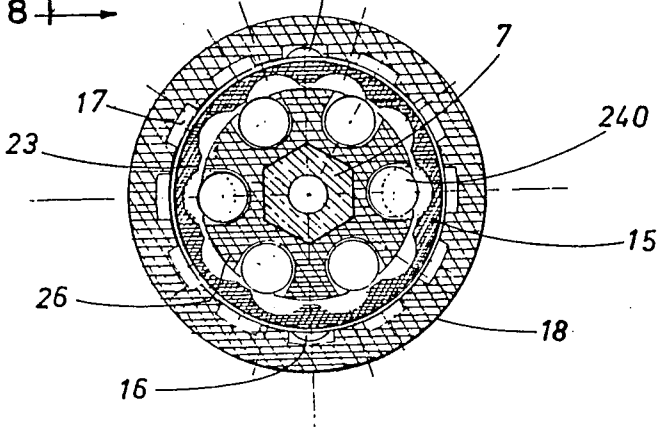
FIG. 8 is a section taken along line VIII—VIII of FIG. 7.

FIGS. 7 and 8 illustrate a different embodiment of the invention, in which those parts common with the embodiment shown in FIGS. 1 to 6 are identified by the same reference numerals.

Again in this embodiment the hollow member 1 comprises a thread 110 for fixing it to the end of the pipe feeding the pressurised water.

In this embodiment, the member 1 comprises a baffle 90 downstream of the radial holes 32 and a tangentially inclined hole 320 downstream of the baffle 90. The baffle 90 and annular member 13 define the chamber in which the impeller 9 rotates, driven by the water entering through the hole 320.

To the downstream end of the hollow member 1 there is screwed a socket 5 with which there is engaged by a male-female threaded engagement, a bushing 15 which extends beyond the end of the member 1. Said bushing 15 comprises a series of equidistant inner longitudinal projections 23 having an arched, transverse shape and tapered downstream ends. In that part of the bushing 15 provided with projections there is received a member 26 rigid with the head 7 which rotates with the shaft 3.

The member 26 comprises a series of radial cavities 25 housing the rollers 240 (FIG. 8).

In addition, immediately downstream of said radial cavities the member 26 carries a rubber ring 260 lying in front of the tapered part of the projections 23.

The member 26 is cup-shaped downstream and is provided with inclined outer channels 261 the purpose of which will be apparent hereinafter. On the upstream end of the member 1 there is slidingly mounted, in a fluid-tight manner, a bushing 300 to which an outer sleeve 18 is fixed by means of the rear ring nut 301 screwed onto the outer sleeve.

Internal to the sleeve 18 there is a tube 302 provided with a hexagonal key seat 303 by which it is maintained in position between bushing 300 and the ends of a series of parallel ribs 17 provided on the inside of the sleeve 18, so as to follow the movements of the sleeve 18. The appendices 16 of the bushing 15 slidingly engage between the ribs 17 of the bushing 15.

At is downstream end, the sleeve 18 comprises the nosepiece 19 with the mouthpiece 20.

The operation of the described second embodiment of the invention is as follows.

In the configuration shown in the upper part of FIG. 7 the device is arranged to deliver water at high pressure.

The water enters the member 1, passes through the holes 32 and is returned to the interior of the member 1 through the tangential hole 320. Here it operates the impeller 9 and reaches the nozzle 6 through the cavity of the shaft 3.

The shaft rotates together with the impeller 9, the speed of rotation being braked by the engagement of the rollers 240 against the projections 23.

The braking action can be increased by turning the sleeve 18 without moving it axially.

The turning of the sleeve 18 is transmitted via the ribs 17 and appendices 16 to the bushing 15 screwed onto the socket 5.

On undergoing suitably directed rotation, the bushing advances towards the left in the figure until it contacts the ring 260 via the tapered ends of the projections 23.

When the bushing 15 has sufficiently advanced, it halts the rotation of the shaft 3, and subsequent turning of the sleeve 18 moves the shaft 3 so as to orientate the inclined nozzle 6 as desired.

In the configuration illustrated in the lower part of FIG. 7, which is obtained by pushing the sleeve 18 forwards (towards the left), the device operates at low pressure.

The water which enters the member 1 and leaves through the radial holes 32 is fed to the outside of the tube 302 and passes through the interspace 28 between the sleeve 18 and said tube 302 and the bushing 15.

After being orientated by the channels 261 so that it forms a jet which rotates about itself, the water emerges from the mouthpiece 20 without undergoing throttling through the nozzle.

A diverging low-pressure jet is formed producing a rotational impulse, as described.

It should be noted that in this configuration the water pressure remains below the limiting value for the operation of a possible detergent ejector located upstream of the device.

The merits and advantages of the present invention are apparent from the aforegoing and from an examination of the accompanying figures. The invention is not limited to the illustrated and described embodiments, but includes all technical equivalents to the aforesaid means and their combinations provided they are implemented within the context of the following claims.

What is claimed is:

1. A device for cleaning surfaces by means of a liquid jet, which comprises a rotatable hollow shaft (3) connected to a liquid entry duct (1) and provided downstream with a delivery nozzle the axis or which is inclined to the longitudinal axis of said shaft;

an impeller (9) fixed on the rotatable hollow shaft to be traversed by the liquid directed towards said nozzle;

a braking unit (23, 24; 240) disposed external to said hollow shaft (3) in order both to adjust the speed with which the shaft rotates and to vary, with respect to a plane, the direction of the nozzle when stationary, and a bypass ducting (28, 17) which connects the zone upstream of the impeller to the zone downstream of the nozzle and is intercepted by a selector (88; 302) arranged to occupy a first position in which it closes the ducting, with the result that all the liquid discharges through the nozzle as a compact filiform jet, and a second position in which it opens said ducting, with the result that part of the liquid discharges directly downstream of the nozzle as a conical jet.

2. The device as claimed in claim 1, characterised in that said braking unit comprises:

a series of rollers (24; 240) freely inserted in respective transverse cavities (25) associated with the hollow shaft;

an adjustment bushing (15) engaged on the downstream end of the duct (1) by a male-female threaded engagement, and provided internally with a rolling track for said rollers (24; 240) which comprises projections (23) tapering towards their downstream end, and locking means (27; 260) associated with said shaft (3) and arranged to make said shaft (3) and said bushing (15) mutually rigid when the rollers contact said projections.

3. The device as claimed in claim 2, characterised in that said locking means (27) comprise a circumferential series of elastically flexible tongues, which when in their undeformed position, have their free ends disposed along a circumference having a diameter greater than the inner diameter of a smooth portion of the bushing (15).

4. The device as claimed in claim 2, characterised in that said locking means (260) consist of a rubber ring disposed within the rotating part, to contact the tapered ends of the projections (23) and produce a progressive braking effect before locking.

5. The device as claimed in any one of the preceding claims, characterised by comprising an outer sleeve (18) which embraces said shaft (3) and duct (1), and is provided with a circumferential series of inner longitudinal grooves (17), in some of which, as a freely slidable fit, there are inserted outer ribs (16) integral with said adjustment bushing (15).

6. The device as claimed in any one of the preceding claims, wherein said bypass ducting (28, 17) consists of a passage provided between said entry duct (1), said adjustment bushing (15) and said sleeve (18) having an upstream end housing said selector (88; 302) in a fluid-tight manner, its downstream end opening into a nosepiece (19) which is fixed to the sleeve (18) and contracts towards the discharge zone of the nozzle (6) to form an outflow mouthpiece (20).

7. The device as claimed in any one of the preceding claims, characterised in that said selector (88; 302) consists of a bushing which is slidingly mounted on the duct (1) and coupled to the sleeve (18), and is possibly provided with transverse holes (31) arranged to communicate with corresponding transverse holes (32) provided in the duct (1).

8. The device as claimed in any one of the proceding claims, characterised in that upstream of the outflow mouthpiece (20) of said nosepiece (19) there are provided equiorientated inclined means (34; 261) arranged to cause the flow arriving from said bypass ducting to undergo a screwing movement.

* * * * *